United States Patent [19]

Wenger

[11] Patent Number: 4,596,195

[45] Date of Patent: Jun. 24, 1986

[54] SHELF CABINET

[76] Inventor: Brahm Wenger, 5525 Ashdale, Côte St-Luc, Quebec, Canada, H4W 3A3

[21] Appl. No.: 622,010

[22] Filed: Jun. 18, 1984

[51] Int. Cl.[4] ..... A47F 5/10

[52] U.S. Cl. ..... 108/31; 108/107; 211/94; 211/105.1; 211/123; 211/204; 312/350

[58] Field of Search ..... 108/29, 31, 107, 110, 108/111; 211/123, 105.1, 186, 94, 204, 206, 162; 312/350

[56] References Cited

U.S. PATENT DOCUMENTS

| | | | |
|---|---|---|---|
| 3,168,365 | 2/1965 | Evans . | |
| 3,174,628 | 3/1965 | Kirch | 211/123 |
| 3,421,634 | 1/1969 | Huth | 211/123 |
| 3,865,336 | 2/1975 | Robertson | 108/29 |
| 4,426,057 | 1/1984 | Nudo . | |

FOREIGN PATENT DOCUMENTS

| | | | |
|---|---|---|---|
| 67664 | 5/1900 | Canada . | |
| 437092 | 12/1946 | Canada . | |
| 781782 | 4/1968 | Canada . | |
| 19476 | 11/1914 | Denmark | 211/123 |
| 2034731 | 1/1972 | Fed. Rep. of Germany | 108/107 |
| 180098 | 5/1922 | United Kingdom | 211/123 |

*Primary Examiner*—William E. Lyddane
*Assistant Examiner*—Joseph Falk
*Attorney, Agent, or Firm*—Schwartz, Jeffery, Schwaab, Mack, Blumenthal & Evans

[57] ABSTRACT

A shelf cabinet has a pair of spaced upright shelf-supporting sidewalls formed with shelf-supporting horizontal grooves into each pair of which a shelf is slidably mounted. The sidewalls are further provided with additional grooves that extend downwardly from and open at one end into the horizontal grooves. Clothes-hanger rods are releasably mounted, at their ends, at the bottom of the downward additional grooves.

19 Claims, 4 Drawing Figures

SHELF CABINET

Figure 1:
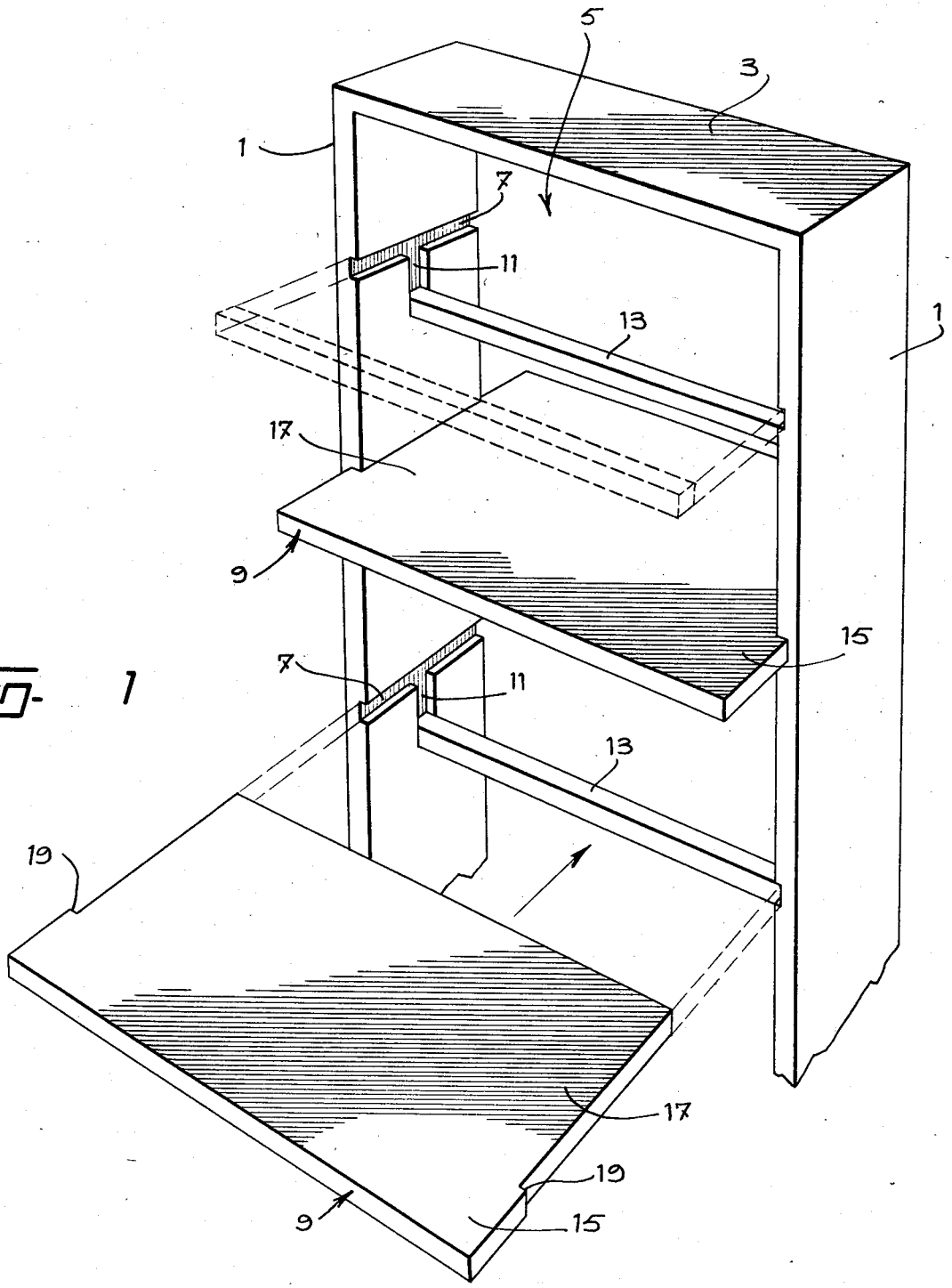

The present invention relates to a shelf cabinet and more particularly to a cabinet for displaying clothes in stores so that the clothes may easily be viewed by the clients. Such a cabinet has two major components: shelves over which folded clothes are layed or stacked and clothes-hanger rods from which certain pieces of garment may hang.

As will be appreciated, it is oftentimes desired to change the display arrangement of clothes in stores to attract more attention, in view of changes in style, to emphasize certain types of garments or for other varied marketing reasons. It follows that there is a need for cabinets that are quite flexible in the physical disposition of the above-mentioned major components so as to afford a rapid and easy relocation as well as addition or removal of shelves and/or clothes-hanger rods.

It is a major object of the present invention to propose such a shelf cabinet which is particularly well adapted to provide the desired flexibility.

Accordingly, the invention as herein broadly claimed is a shelf cabinet comprising: a pair of spaced upright shelf-supporting sidewalls formed with at least one pair of horizontal grooves for the slidable and releasable mounting therein of a shelf, one groove being provided on each of said sidewalls; said sidewalls being provided with further grooves extending downwardly from and opening at one end into said horizontal grooves for the slidable and releasable mounting therein of at least one clothes-hanger rod releasably mounted, at the ends thereof, at the bottom of said further grooves.

Preferably, the cabinet includes means for joining the sidewalls at the top and at the bottom only so as to define a generally rectangular upright frame which is open at the front and at the back. Thus, the horizontal grooves could be made to extend fully across the sidewalls so that the shelves may be slidably inserted in the grooves from either of the front or the back.

A search made prior to the filing of the present invention has revealed some prior patents which, while of interest, fail to give satisfaction as to the feasibility of rearranging, rapidly and easily, the shelves and clother-hanging rods. Nor do they provide a display cabinet that can be manufactured at low cost. The prior patent to which reference is made are: U.S. Pat. Nos. 3,158,365 of 1965; 4,426,057 of 1984; Canadian patent Nos. 67,664 of 1900; 437,092 of 1946; 781,782 of 1968.

More specifically, while these patents relate to shelf cabinets of different types, none discloses nor suggests the above features of readily inserted and removable shelves on upright sidewalls in combination with clothes-hanger rods of which the ends are mounted at the bottom of vertical grooves that depend from and open into the horizontal grooves into which the shelves are slid. According to the present invention, the clothe-shanger rods can thus be put into position and removed extremely simply and rapidly merely by sliding the relevant shelves out of their horizontal grooves. This type of construction further affords easy rearrangement of the shelves and of the clothes-hanger rods to provide different display possibilities.

Figure 2:
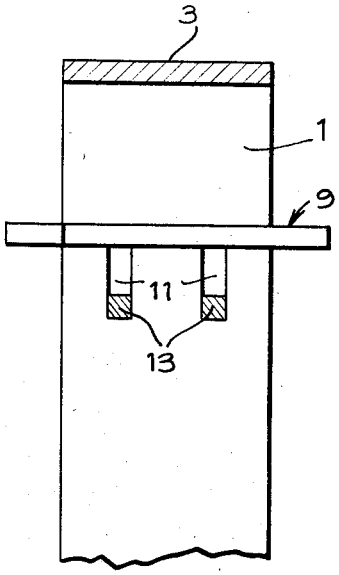
Figure 3:
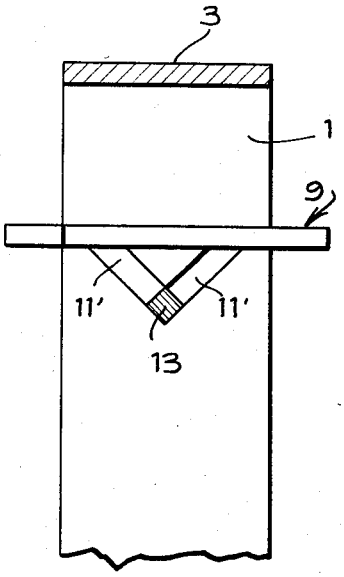
Figure 4:
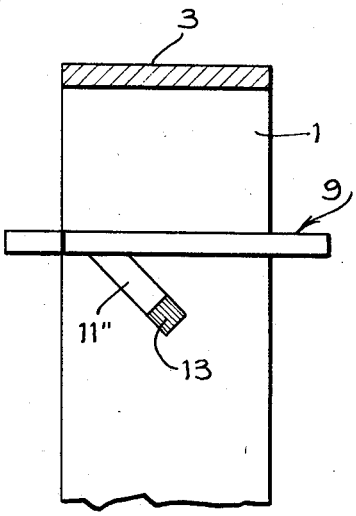

The description of a preferred embodiment of the invention now follows, with variants, having reference to the appended drawings wherein:

FIG. 1 is a perspective view of a relevant part of a cabinet made according to the invention, shown partly exploded, and FIGS. 2, 3 and 4 are partial vertical crosssectional view of variants of the cabinet of FIG. 1 with respect to the downwardly projecting grooves for the clothes-hanging rods.

Referring to FIG. 1, it will be seen that the cabinet generally comprises a pair of straight, usually parallel, upright spaced sidewalls 1 interconnected by a top wall 3 as well as a bottom wall ( not shown) so as to define therebetween a generally rectangular enclosure open both at the front and at the back. Each sidewall 1 is formed, inwardly with respect to the enclosure 5, with a plurality of horizontal grooves 7, disposed in pairs, for supporting shelves 9, each being slidably mounted in the grooves 7. As shown in FIG. 1, these grooves 7 preferably run fully across the sidewalls 1 so that the shelves 9 may be slid into them from either the back or the front of the cabinet.

The sidewalls are additionally provided with further grooves 11 that extend downwardly from and open at one end into the horizontal grooves 7.

Clothes-hanger rods 13 are releasably mounted, at their ends, at the bottom of the grooves 11.

As is clearly apparent from FIG. 1, the clothes-hanger rods are put into position in their grooves 11 simply by slidably removing the shelves 9 and sliding the clothes-hanger rods successively along the grooves 7 and 11. As the shelves 9 are flat, it is obvious that the grooves 7 will preferably be rectangular in cross-section and to prevent the clothes-hanger rods 13 from pivoting about their longitudinal axis, the downward grooves 11 are similarly rectangular in cross-section.

There will of course be as many pairs of grooves 7 as desired. Likewise, there may be as many downward grooves 11 as desired, usually one pair of such grooves 11 for each panel 9 so as to afford as much flexibility as possible in the arrangement of the shelves 9 and rods 13.

In the embodiment of FIG. 1, as mentioned above, the grooves 7 extend fully across the sidewalls 1 so that both the shelves 9 and the rods 13 may be inserted into position from either the front or the back of the cabinet. In fact, the only distinction between the front and back of the cabinet shown in FIG. 1 is that the shelves 9 are provided with stop means, on the shelves edges that are inserted into the horizontal grooves 7, so as to control the length of insertion of the shelves in the horizontal grooves. In the embodiment of FIG. 1, each shelf comprises a narrow portion 15 and a wide portion 17 extending from the narrow portion 15, the aforesaid stop means being shoulders 19 formed at the intersection of the shelf portions 15 and 17.

In the variant shown in FIG. 2, each sidewall 1 has a pair of parallel downwardly projecting grooves 11 perpendicular to the respective horizontal groove 7 thereby affording the location of two clothes-hanger rods 13 whereby to afford different arrangements of clothes-hanging.

FIG. 3 shows another variant wherein the two grooves 11′ extend downwardly at a predetermined angle and join one another at an apex where the rod 13 may be located by being slid from either the back or the front of the cabinet.

The variant of FIG. 4 is similar to that in FIG. 3 but only one single inclined downwardly projecting groove 11″ is provided. The inclination of the grooves 11′ or 11" makes it also possible to insert the rods 13 more easily.

As will have been seen from the above description, a shelf and clothes-hanger rod cabinet has been provided which affords all types of clothes display arrangements with extreme facility and at as reduced a cost as possible, in accordance with the main object of the present invention as hereinafter claimed.

The embodiments of the invention in which an exclusive property or privilege is claimed are defined as follows:

1. A shelf cabinet comprising: a pair of spaced upright shelf-supporting sidewalls formed with at least one pair of horizontal grooves, one groove being provided on each of said sidewalls; said sidewalls being additionally provided with further grooves extending downwardly from and opening at one end into said horizontal grooves; a shelf slidably and releasably mounted in said at least one pair of grooves and a clothes hanger rod slidably and releasably mounted in said further grooves in a position spaced below said shelf; wherein said horizontal grooves extend fully across said sidewalls whereby said shelf may be slidably inserted therein from either one of the side edges of said sidewalls.

2. A shelf cabinet as claimed in claim 1, further including a shelf slidably mounted in said horizontal grooves and at least one clothes-hanger rod releasably munted, at the ends thereof, at the bottom of said further grooves.

3. A shelf cabinet as claimed in claim 2, comprising two pairs of further grooves and two clothes-hanger rods releasably mounted at the bottom of said further grooves, said further grooves extending down perpendicularly from said horizontal grooves.

4. A shelf cabinet as claimed in claim 2, wherein said further grooves are provided in pairs on said sidewalls, are inclined toward one another and meet one another at an apex, said clothes-hanging rod lying at said apices of said pairs of inclined grooves.

5. A shelf cabinet according to claim 1, wherein said further grooves are two in number, one on each of said sidewalls, said further grooves being inclined with respect to said horizontal grooves.

6. A shelf cabinet according to claim 2, wherein said grooves and said rod are square in cross-section, said rod non-rotatably slidably fitting in said grooves.

7. A shelf cabinet as claimed in claim 1, comprising stop means on said shelf along edges thereof that are inserted into said horizontal grooves, whereby to control the length of insertion of said shelf in said horizontal grooves.

8. A shelf cabinet according to claim 7, wherein said shelf comprises a narrow portion inserted into said horizontal grooves and a wide portion extending from said narrow portion, said stop means being shoulders formed at the intersection of said shelf portions.

9. A shelf cabinet as claimed in claim 1, including means joining said sidewalls at the top and at the bottom thereof whereby to define therewith a generally rectangular upright frame open at the front and back.

10. A shelf cabinet comprising: a pair of parallel upright spaced sidewalls defining an enclosure therebetween, each sidewall being formed with a plurality of horizontal shelf-supporting grooves opening towards said enclosure, said grooves of one of said sidewalls pairing with the grooves of the other sidewall; shelves, each slidably mounted in the grooves of one of said pairs of grooves; said sidewalls being provided with further grooves arranged in pairs between said sidewalls; wherein said further grooves extend downwardly from and open at one end into said horizontal grooves; and clothes-hanger rods releasably mounted, at the ends thereof, at the bottom of said further grooves spaced below said shelf; wherein said horizontal grooves extend fully across said sidewalls whereby said shelves may be slidably inserted therein from either one of the side edges of said sidewalls.

11. A shelf cabinet as claimed in claim 10, wherein said further grooves extend down perpendicularly from said horizontal grooves.

12. A shelf cabinet as claimed in claim 10, wherein said further grooves are provided in pairs on said sidewalls, are inclined toward one another and meet one another at an apex, said clothes-hanger rods lying at said apices of said pairs of inclined further grooves.

13. A shelf cabinet as claimed in claim 10, wherein the further grooves of each pair are inclined at one predetermined angle from said horizontal grooves.

14. A shelf cabinet as claimed in claim 10, wherein said grooves and said rods are square in cross-section, said rods non-rotatably slidably fitting in said grooves.

15. A shelf cabinet as claimed in claim 10, comprising stop means on said shelves along the edges thereof that are inserted into one of said pairs of horizontal grooves whereby to control the length of insertion of said shelves in said horizontal grooves.

16. A shelf cabinet as claimed in claim 15, wherein each shelf comprises a narrow portion inserted in said horizontal grooves and a wide portion extending from said narrow portion, said stop means being shoulders formed at the intersection of said shelf portions.

17. A shelf cabinet as claimed in claim 10, including means joining said sidewalls at the top and at the bottom thereof whereby to define therewith a generally rectangular upright frame open at the front and back.

18. A shelf cabinet as claimed in claim 17, wherein said horizontal grooves extend fully across said sidewalls whereby said shelves may be slidably inserted therein selectively from the front and from the back of said upright frame.

19. A shelf cabinet as claimed in claim 9, wherein said horizontal grooves extend fully across said sidewalls whereby said shelves may be slidably inserted therein selectively from the front and from the back of said upright frame.

* * * * *